US010493601B2

(12) United States Patent
Ruqian

(10) Patent No.: US 10,493,601 B2
(45) Date of Patent: Dec. 3, 2019

(54) COMPOUND PLIERS

(71) Applicant: Zhang Ruqian, Xiaoshan Hangzhou (CN)

(72) Inventor: Zhang Ruqian, Xiaoshan Hangzhou (CN)

( * ) Notice: Subject to any disclaimer, the term of this patent is extended or adjusted under 35 U.S.C. 154(b) by 11 days.

(21) Appl. No.: 15/873,245

(22) Filed: Jan. 17, 2018

(65) Prior Publication Data

US 2019/0217448 A1 Jul. 18, 2019

(51) Int. Cl.
*B25B 7/06* (2006.01)
*B25B 7/12* (2006.01)
*B25B 7/08* (2006.01)

(52) U.S. Cl.
CPC ..... *B25B 7/06* (2013.01); *B25B 7/08* (2013.01); *B25B 7/12* (2013.01)

(58) Field of Classification Search
CPC ..... B25B 7/06; B25B 7/08; B25B 7/12
See application file for complete search history.

(56) References Cited

U.S. PATENT DOCUMENTS 1,469,306 A * 10/1923 Kauffman ..... B25B 7/12 81/351
2,857,795 A * 10/1958 Workman ..... B25B 7/10 81/351
2,972,270 A * 2/1961 Krolick ..... B21D 39/02 72/409.11
5,176,049 A * 1/1993 Neff ..... B25B 7/10 81/358
6,065,376 A * 5/2000 Khachatoorian ..... B25B 7/10 81/341
6,408,725 B1 * 6/2002 Janson ..... B25B 7/10 81/382
7,444,851 B1 * 11/2008 Janson ..... B25B 7/12 72/409.12
8,393,254 B2 * 3/2013 Gao ..... A61B 17/2804 294/2
9,016,102 B2 * 4/2015 Harvey ..... B25B 7/02 72/409.01
9,061,398 B2 * 6/2015 Poole ..... B25B 7/12
9,242,350 B2 * 1/2016 Buchanan ..... B25B 7/02
9,352,454 B1 * 5/2016 Aldredge ..... B25B 7/123
9,821,438 B2 * 11/2017 Xu ..... B25B 7/10
2003/0164073 A1 * 9/2003 Chen ..... B25B 7/12 81/342
2012/0096994 A1 * 4/2012 Poole ..... B25B 7/12 81/342
2012/0144963 A1 * 6/2012 He ..... B25B 7/12 81/381

* cited by examiner

*Primary Examiner* — David B. Thomas
(74) *Attorney, Agent, or Firm* — Clement Cheng

(57) ABSTRACT

A compound pliers has a main joint pivotally connecting a right jaw to a left jaw; a right jaw lever extending from the left jaw and a left jaw lever extending from the right jaw; an auxiliary joint pivotally connecting a right handle joint lever to a left handle joint lever; a right handle joint connecting a right jaw lever to a right handle joint lever; a left handle joint connecting a left jaw lever to a left handle joint lever; and a right handle indent formed on the right jaw lever. The right handle indent receives an auxiliary joint protrusion. The auxiliary joint protrusion is formed around the auxiliary joint.

11 Claims, 8 Drawing Sheets

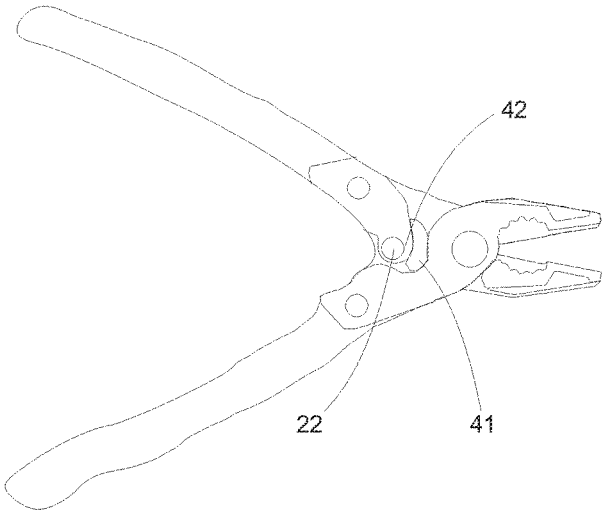
Fig. 1
Fig. 2
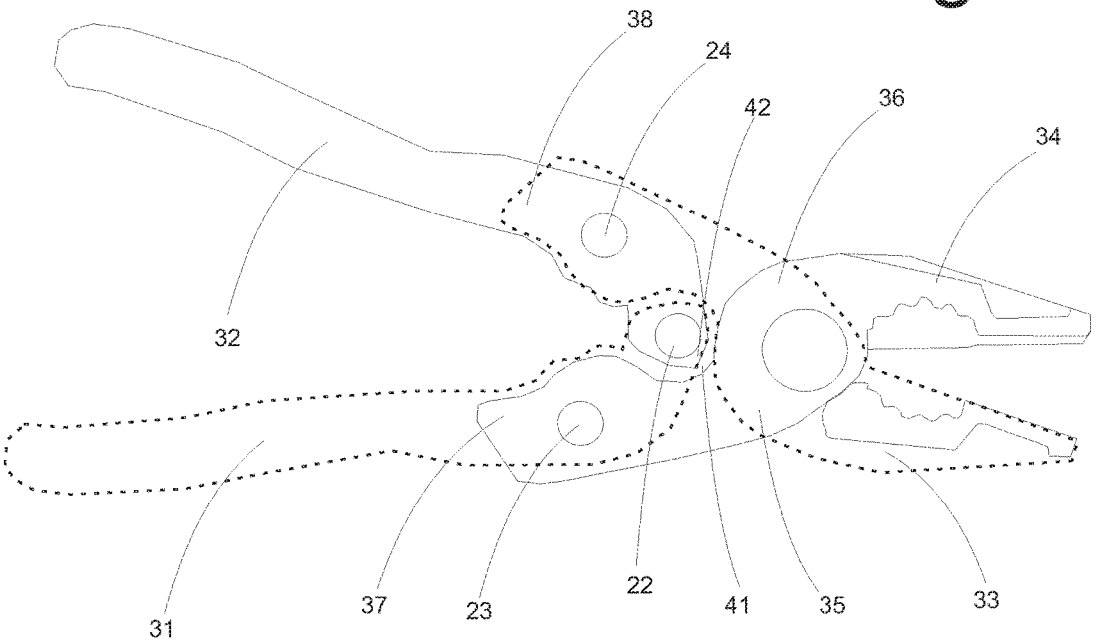

COMPOUND PLIERS

FIELD OF THE INVENTION

The present invention is in the field of compound pliers.

DISCUSSION OF RELATED ART

Pliers are a hand tool used to hold objects firmly in place. They are useful for bending and compressing a wide range of materials, users have a variety of different pliers available to them for completing such tasks. Compound pliers amplify the amount of force generated from squeezing the handles, resulting in significantly more gripping and cutting power over conventional pliers.

In U.S. Pat. No. 9,821,438B2, filed Nov. 21, 2017, Xu et al describes a set of self-adjusting pliers that contain a piston pivotally attached at a first end and a jaw on another. The piston is also pivotally attached at a second end to the second body and compressible about an axis extending between the first end and the second end. With the disclosed invention, users are able to adjust rapidly the pliers' jaw members. Another example of pliers include U.S. Pat. No. 8,682,463B1, filed on Jun. 20, 2017 by Aldredge et al. The patent discloses locking pliers that includes a fixed jaw, a moveable jaw, a fixed handle, a toggle link, a power link and a moveable handle. An adjustment screw is retained in a second end of the fixed handle, allowing the pliers to lock, resulting in a hand tool that requires less effort to operate than that of prior art.

A variety of different compound pliers have been created over the years to help alleviate the problem with gripping and cutting power that traditional pliers have. For example, a compound pliers as described in U.S. Pat. No. 9,242,350B2 filed Jan. 26, 2016 by Buchanan discloses a pliers apparatus that comprises two arms, two jaws, struts and a switch allowing the apparatus to function as a ratcheting device, pliers and clamps. The pliers' apparatus comprises of two arms, two jaws, struts and a switch as well as an extremely strong method of resiliently closing or locking, allowing the device to switch depending on the function that is needed.

Some compound pliers are also capable of finer adjustments when used for gripping material. For example, inventor Neff, in U.S. Pat. No. 5,176,049, filed Jan. 5, 1993, discusses a compound gripping tool that includes constantly parallel jaws at any adjustment position within its capacity. When constructed as pliers, it grips the work piece with a 10:1 leverage ratio, making it practically impossible to slip without the operator releasing its grip. Another compound pliers system includes auto-adjusting pliers with a first elongated fixed jaw at one end and an elongated handle at the other. Inventor Zareh Khachatorian, in U.S. Pat. No. 6,065,376 and filed May 23, 2000, discloses a unique compound pliers that not only boasts safety features but additional degrees of freedom of linear movements due to the inclusion of slots in the pliers system. The usage of different pins in the compound pliers system allows this to occur.

SUMMARY OF THE INVENTION

A compound pliers has a main joint pivotally connecting a right jaw to a left jaw; a right jaw lever extending from the left jaw and a left jaw lever extending from the right jaw; an auxiliary joint pivotally connecting a right handle joint lever to a left handle joint lever; a right handle joint connecting a right jaw lever to a right handle joint lever; a left handle joint connecting a left jaw lever to a left handle joint lever; and a right handle indent formed on the right jaw lever. The right handle indent receives an auxiliary joint protrusion. The auxiliary joint protrusion is formed around the auxiliary joint. The compound pliers are formed in layers, namely an upper layer and a lower layer. The upper layer is above the lower layer. The right handle joint lever is formed on the lower layer and is connected to the left handle joint lever, which is on the upper layer.

The compound pliers are formed in layers, namely an upper layer and a lower layer. The upper layer is above the lower layer. The right jaw lever is formed on the upper layer and is pivotally connected to the left jaw lever formed on the lower layer because the main joint connects the upper layer to the lower layer. The right jaw lever is formed on the upper layer and is pivotally connected to the right handle joint lever on the lower layer because the right handle joint connects the upper layer to the lower layer.

BRIEF DESCRIPTION OF THE DRAWINGS

FIG. 1 is a top view of the present invention.

FIG. 2 is a top view diagram of the present invention showing each moving part.

Figure 3:
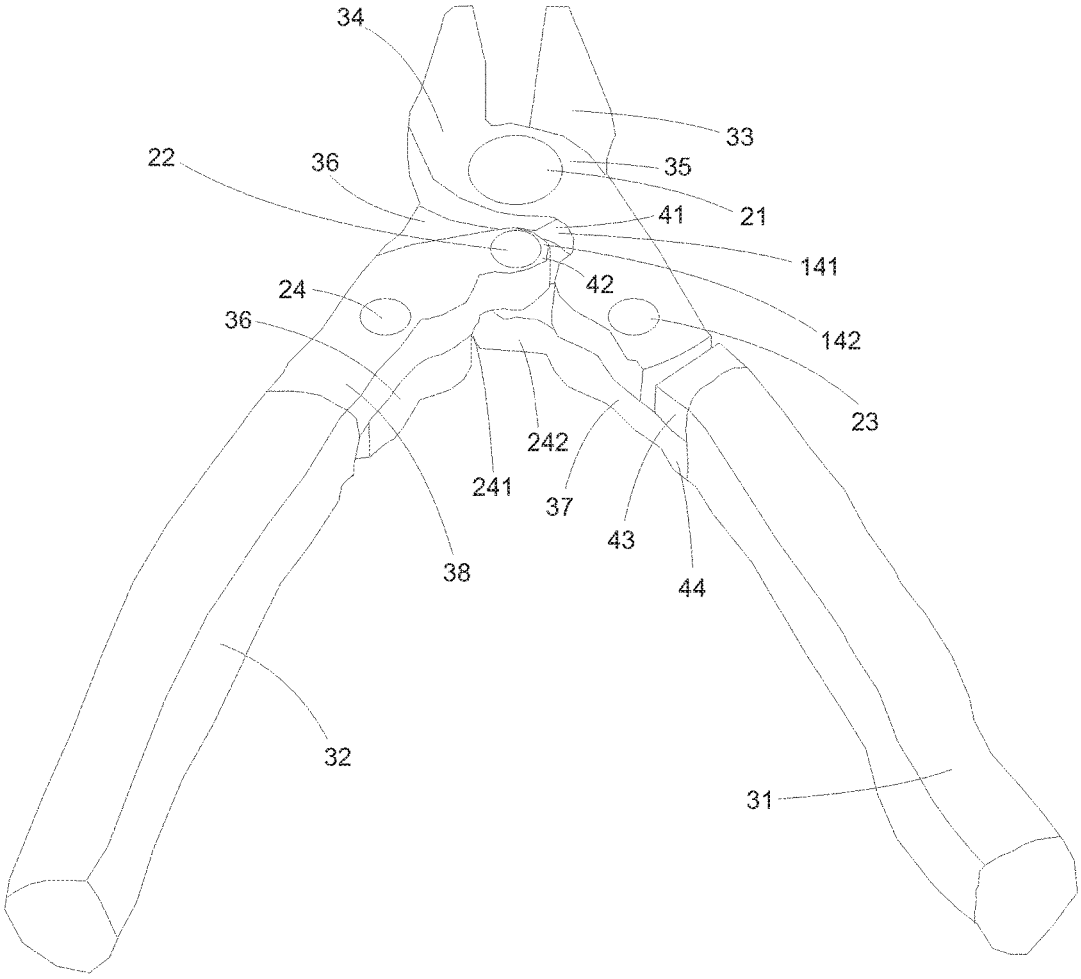
FIG. 3 is a perspective top view of the present invention showing the double layer nature of the invention. The perspective bottom view of the present invention is the same as the perspective top view of the present invention because flipping the pliers over produces the same orientation as the pliers has a rotational symmetry.
Figure 4:
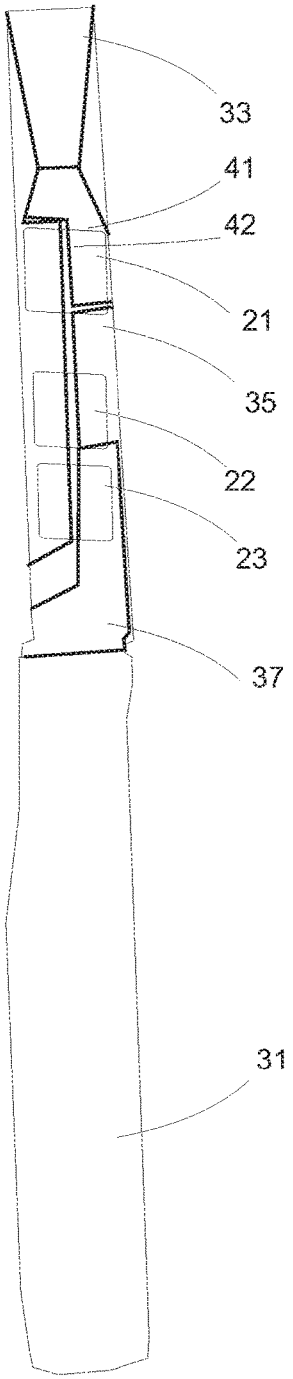
FIG. 4 is a left side view of the present invention.
Figure 5:
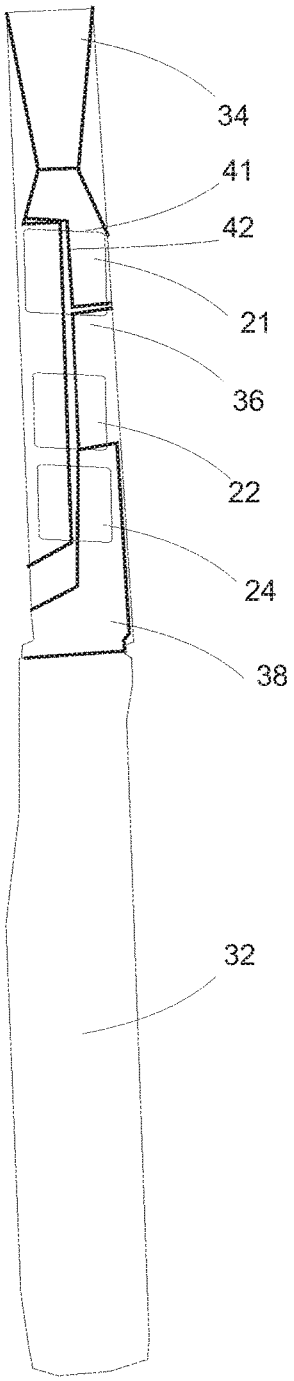
FIG. 5 is a right side view of the present invention, which is the same as the left side view of the present invention.
Figure 6:
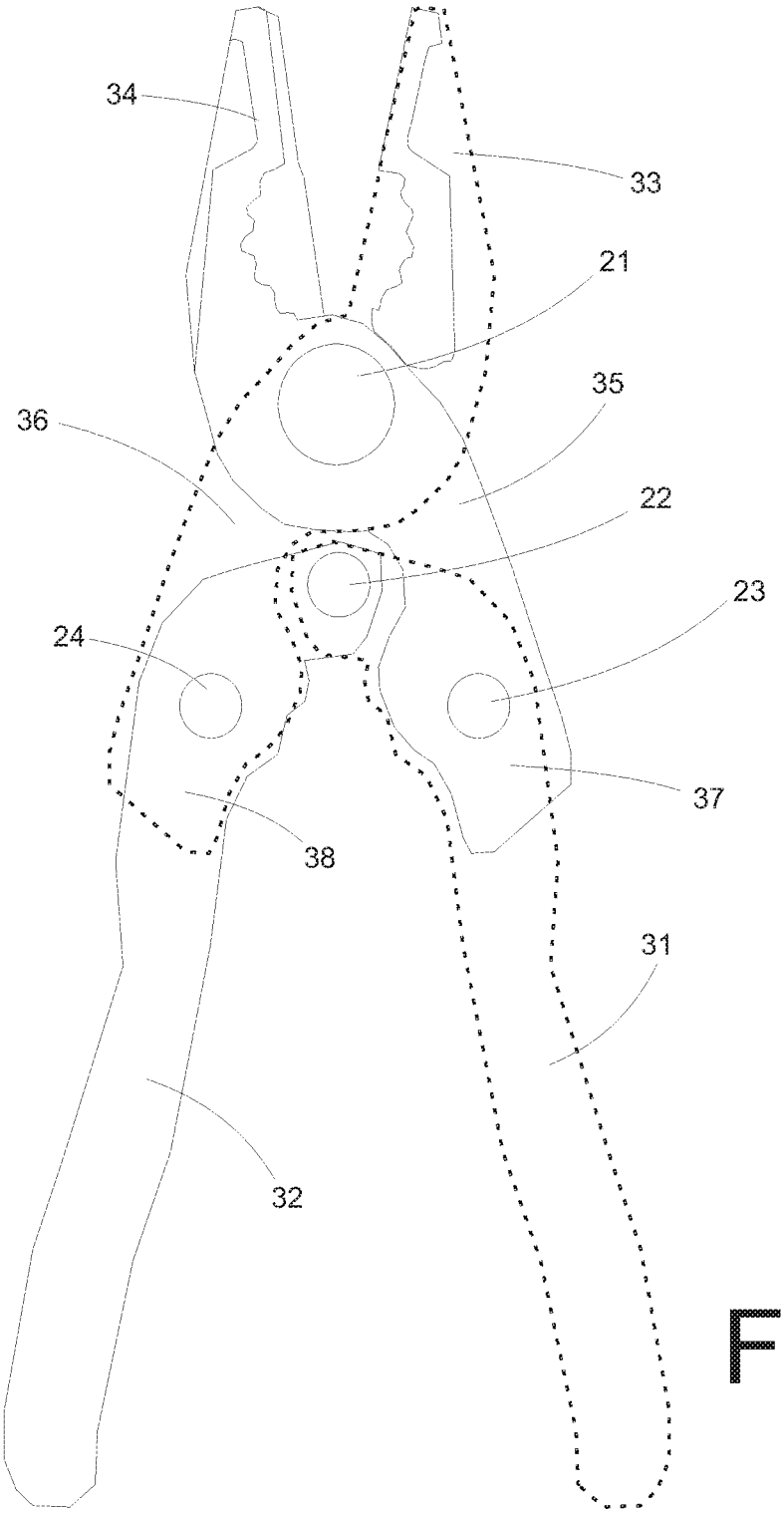
FIG. 6 is a top view of the present invention again showing the relations of the moving parts.
Figure 7:
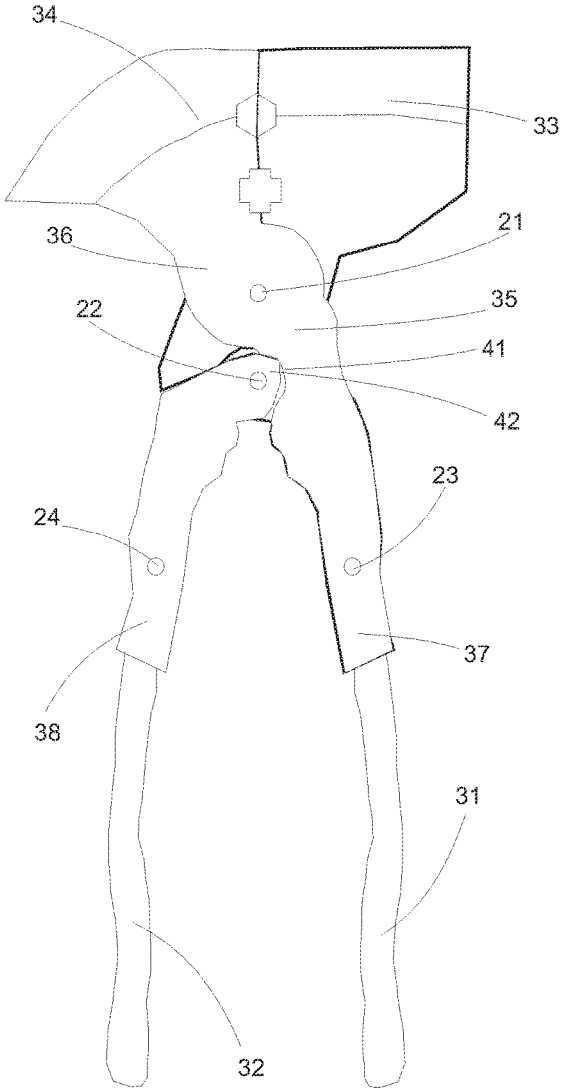
FIG. 7 is a diagram of a masonry hammer to show that the present invention can be used for implementing a masonry hammer.
Figure 8:
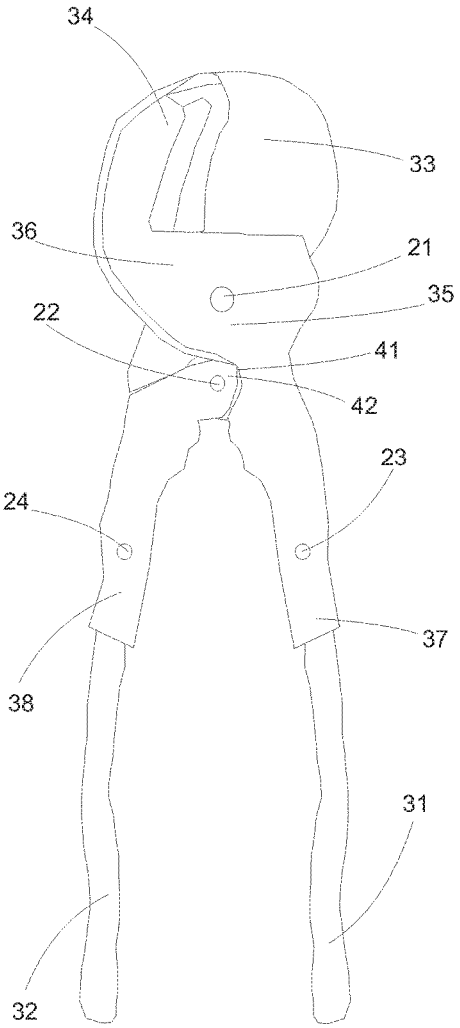
FIG. 8 is a shear to show that the present invention can be used for implementing shears.
Figure 9:
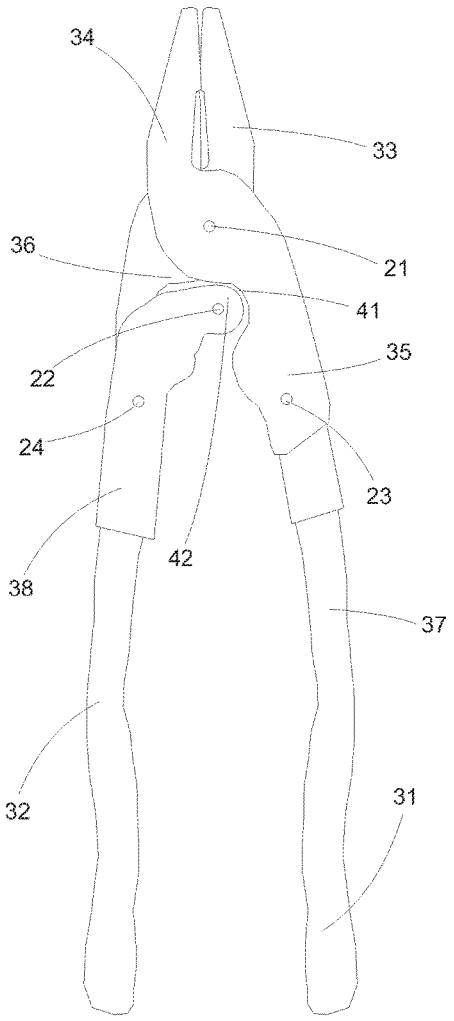
FIG. 9 is a short locking pliers with cutter to show that the present invention can be used for implementing short locking pliers.
Figure 10:
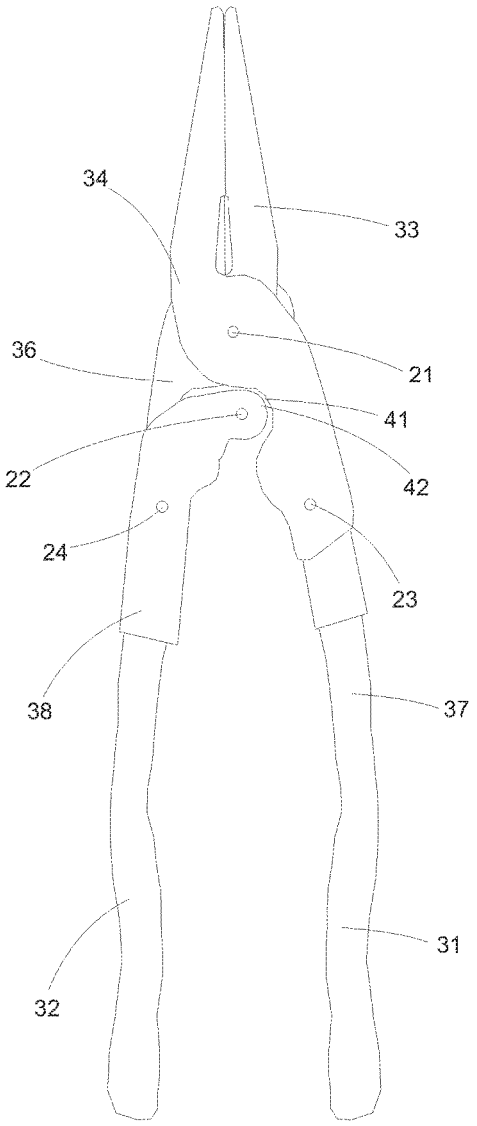
FIG. 10 is a needle nose pliers to show that the present invention can be used for implementing needle nose pliers.
Figure 11:
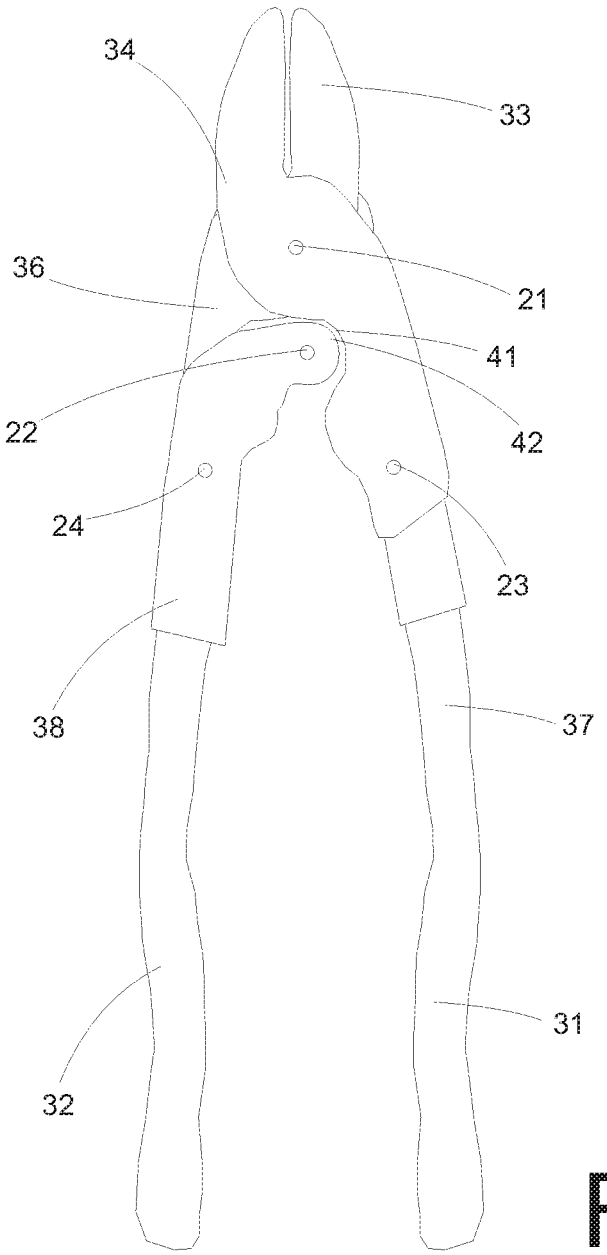
FIG. 11 is a cutter to show that the present invention can be used for implementing a cutter.
Figure 12:
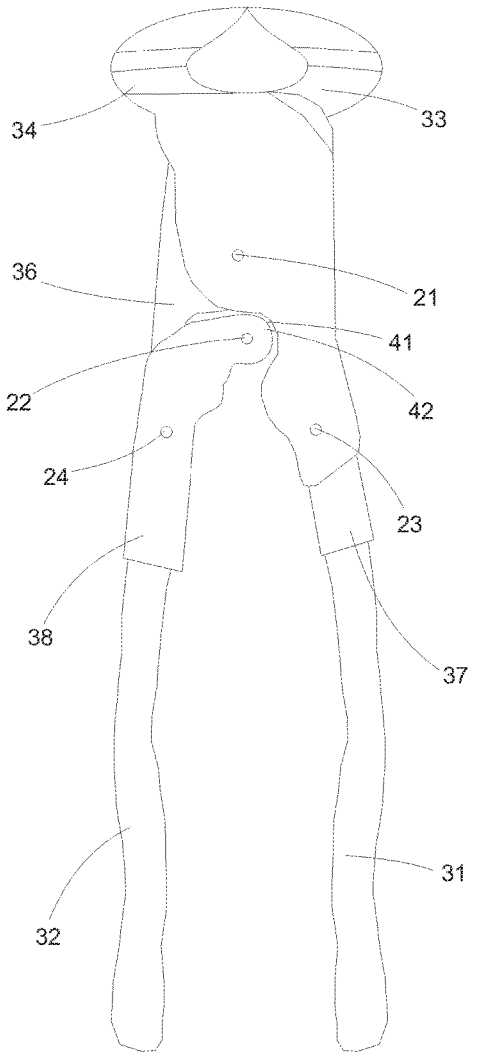
FIG. 12 is a masonry tile nipper to show that the present invention can be used for implementing a masonry tile nipper.
Figure 13:
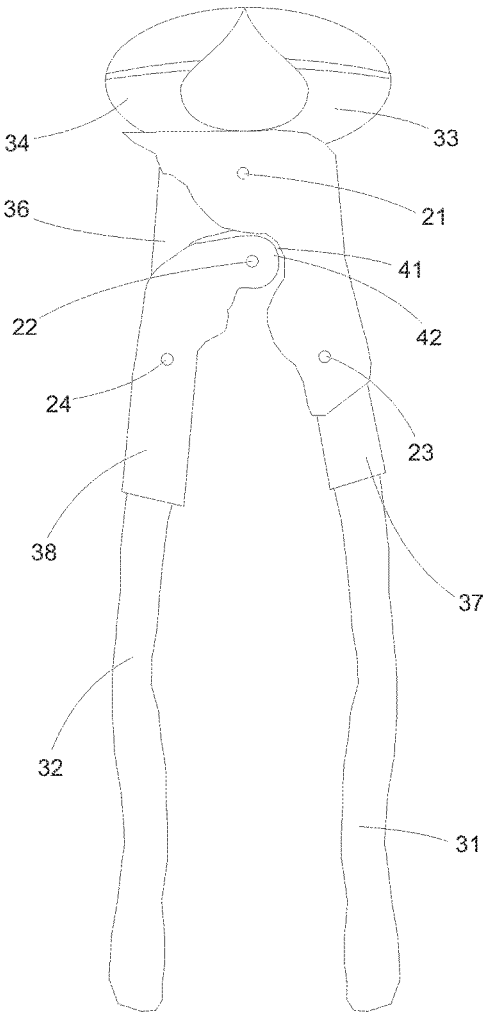
FIG. 13 is a masonry tile nipper to show that the present invention can be used for implementing a masonry tile nipper.

The following call out list of elements can be a useful guide in referencing the elements of the drawings.

21 main joint
22 auxillary joint
23 right handle joint
24 left handle joint
31 right handle
32 left handle
33 right jaw
34 left jaw
35 right jaw lever
36 left jaw lever
37 right handle joint lever

38 left handle joint lever
41 right handle indent
42 auxiliary joint protrusion
43 first level
44 second level
141 Upper right handle indent
142 upper auxiliary joint protrusion
241 lower right handle indent
242 lower auxiliary joint protrusion

DETAILED DESCRIPTION OF THE PREFERRED EMBODIMENT

As seen in FIGS. 1-3, the main joint is a pivotal connection that is connected to a right jaw 33 and a left jaw 34. The right jaw 33 and the left jaw 34 cooperate to grasp an object. The right jaw 33 is integrally formed and moves with a left jaw lever 36. Similarly, the left jaw 34 is integrally formed and moves with the right jaw lever 35. Thus, the main joint operates as a normal pair of pliers that connects the right and left jaw members.

The compound portion is implemented with the auxiliary joint 22. The auxiliary joint 22 provides a joint between the right handle joint lever 37 and the left handle joint lever 38. A right handle 31 extends from the right handle joint lever 37 and is rigidly connected to the right handle joint lever 37. Similarly, a left handle 32 is rigidly connected to the left handle joint lever 38 and extends from the left handle joint lever 38. The left handle joint lever 38 and the right handle joint lever 37 are hinged at the auxiliary joint 22.

The left handle joint lever 38 and the right handle joint lever 37 are also hinged to form a four bar mechanism. The left handle joint lever 38 is hinged to the left jaw lever 36 at the left handle joint 24. Similarly, the right jaw lever 35 is hinged to the right handle joint lever 37 at the right handle joint 23.

The right handle joint lever 37 includes an indentation, namely the right handle indent 41. The auxiliary joint 22 is formed on an auxiliary joint protrusion 42, which protrudes into the right handle indent 41. The right handle indent 41 is rounded and receives a rounded portion of the auxiliary joint protrusion 42.

The right handle indent 41 is formed in a pair including an upper right handle indent 141 above a lower right handle indent 241. Similarly, the auxiliary joint protrusion 42 is formed in a pair including an upper auxiliary joint protrusion 142 and a lower auxiliary joint protrusion 242. The pair of right handle indents 41 extend into the pair of auxiliary joint protrusions 42. The pair of right handle indent 41 are centered below the main joint 21. The pair of auxiliary joint protrusions 42 extend toward and away from each other during motion of the pliers handles.

The upper auxiliary joint protrusion 142 is on a first level 43 and the lower auxiliary joint protrusion 241 is on a second level 44 below the upper auxiliary joint protrusion 141. The first level 43 is the upper level and the second level 44 is the lower level. When the pair of pliers is flipped, the upper level becomes the lower level and the lower level becomes the upper level. Because the pair of pliers is symmetrical when rotated, the configuration remains the same after rotation. The upper right handle indent 141 opposes the lower right handle indent 241. The upper right handle indent 141 is formed on the right jaw lever 35 and the lower right handle indent 241 is formed on the left jaw lever 36.

The pair of pliers is constructed in an upper layer and a lower layer. The upper layer 43 is above the lower layer 44. The right handle joint lever 37 is formed on the lower layer and is connected to the left handle joint lever 38 which is on the upper layer. Similarly, the right jaw lever 35 is formed on the upper layer and is pivotally connected to the left jaw lever 36 formed on the lower layer because the main joint 21 connects the upper layer to the lower layer. The right jaw lever 35 is formed on the upper layer and is pivotally connected to the right handle joint lever 37 on the lower layer because the right handle joint 23 connects the upper layer to the lower layer. The left handle joint lever 38 is formed on the upper layer and pivotally connected to the left jaw lever 36 because the left handle joint 24 connects the upper layer to the lower layer. Finally, the left handle joint lever 38 formed on the upper layer is pivotally connected to the right handle joint lever 37 formed on the lower layer because the auxiliary joint 22 connects the upper layer to the lower layer.

The invention claimed is:

1. A compound pliers comprising:
- a main joint pivotally connecting a right jaw to a left jaw;
- a right jaw lever extending from the left jaw and a left jaw lever extending from the right jaw;
- an auxiliary joint pivotally connecting a right handle joint lever to a left handle joint lever;
- a right handle joint connecting a right jaw lever to a right handle joint lever;
- a left handle joint connecting a left jaw lever to a left handle joint lever; and
- a right handle indent formed on the right jaw lever, wherein the right handle indent receives an auxiliary joint protrusion, wherein the auxiliary joint protrusion is formed around the auxiliary joint.

2. The compound pliers of claim 1, wherein the compound pliers are formed in layers, namely an upper layer and a lower layer, wherein the upper layer is above the lower layer, wherein the right handle joint lever is formed on the lower layer and is connected to the left handle joint lever which is on the upper layer.

3. The compound pliers of claim 1, wherein the compound pliers are formed in layers, namely an upper layer and a lower layer, wherein the upper layer is above the lower layer, wherein the right jaw lever is formed on the upper layer and is pivotally connected to the left jaw lever formed on the lower layer because the main joint connects the upper layer to the lower layer.

4. The compound pliers of claim 3, wherein the right jaw lever is formed on the upper layer and is pivotally connected to the right handle joint lever on the lower layer because the right handle joint connects the upper layer to the lower layer.

5. The compound pliers of claim 3, wherein the left handle joint lever is formed on the upper layer and pivotally connected to the left jaw lever because the left handle joint connects the upper layer to the lower layer.

6. The compound pliers of claim 3, wherein the left handle joint lever formed on the upper layer is pivotally connected to the right handle joint lever formed on the lower layer because the auxiliary joint connects the upper layer to the lower layer.

7. The compound pliers of claim 1, wherein the compound pliers are formed in layers, namely an upper layer and a lower layer, wherein the upper layer is above the lower layer, wherein the right jaw lever is formed on the upper layer and is pivotally connected to the right handle joint lever on the lower layer because the right handle joint connects the upper layer to the lower layer.

8. The compound pliers of claim 7, wherein the compound pliers are formed in layers, namely an upper layer and a lower layer, wherein the upper layer is above the lower layer, wherein the left handle joint lever is formed on the upper layer and pivotally connected to the left jaw lever because the left handle joint connects the upper layer to the lower layer.

9. The compound pliers of claim 7, wherein the compound pliers are formed in layers, namely an upper layer and a lower layer, wherein the left handle joint lever formed on the upper layer is pivotally connected to the right handle joint lever formed on the lower layer because the auxiliary joint connects the upper layer to the lower layer.

10. The compound pliers of claim 1, wherein the compound pliers are formed in layers, namely an upper layer and a lower layer, wherein the upper layer is above the lower layer, wherein the left handle joint lever is formed on the upper layer and pivotally connected to the left jaw lever because the left handle joint connects the upper layer to the lower layer.

11. The compound pliers of claim 10, wherein the compound pliers are formed in layers, namely an upper layer and a lower layer, wherein the left handle joint lever formed on the upper layer is pivotally connected to the right handle joint lever formed on the lower layer because the auxiliary joint connects the upper layer to the lower layer.

* * * * *